US009261816B2

(12) United States Patent
Sakaya et al.

(10) Patent No.: US 9,261,816 B2
(45) Date of Patent: Feb. 16, 2016

(54) DEVELOPER AMOUNT DETECTOR, DEVELOPING DEVICE, PROCESS UNIT, AND IMAGE FORMING APPARATUS

(71) Applicants: Kohta Sakaya, Hyogo (JP); Shinichi Arasawa, Hyogo (JP); Yasuhide Ohkubo, Osaka (JP); Yasunobu Ogata, Hyogo (JP)

(72) Inventors: Kohta Sakaya, Hyogo (JP); Shinichi Arasawa, Hyogo (JP); Yasuhide Ohkubo, Osaka (JP); Yasunobu Ogata, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/532,501

(22) Filed: Nov. 4, 2014

(65) Prior Publication Data

US 2015/0132018 A1 May 14, 2015

(30) Foreign Application Priority Data

Nov. 14, 2013 (JP) ..... 2013-236185

(51) Int. Cl.
*G03G 15/08* (2006.01)
*G03G 15/00* (2006.01)

(52) U.S. Cl.
CPC ..... *G03G 15/0862* (2013.01); *G03G 15/0824* (2013.01); *G03G 15/0831* (2013.01); *G03G 15/553* (2013.01); *G03G 2215/0888* (2013.01); *G03G 2221/183* (2013.01)

(58) Field of Classification Search
CPC ..... G03G 15/08
USPC ..... 399/27
See application file for complete search history.

(56) References Cited

U.S. PATENT DOCUMENTS

| | | | | |
|---|---|---|---|---|
| 2011/0052256 | A1 | 3/2011 | Arasawa | |
| 2011/0194864 | A1* | 8/2011 | Nakatake et al. | 399/27 |
| 2011/0217055 | A1 | 9/2011 | Takehara et al. | |
| 2012/0033997 | A1 | 2/2012 | Fujita et al. | |
| 2012/0189327 | A1* | 7/2012 | Kubota et al. | 399/27 |
| 2013/0136465 | A1 | 5/2013 | Yoshida et al. | |

FOREIGN PATENT DOCUMENTS

| | | |
|---|---|---|
| JP | 2-166483 | 6/1990 |
| JP | 6-308832 | 11/1994 |
| JP | 7-295361 | 11/1995 |
| JP | 8-314283 | 11/1996 |
| JP | 9-258545 | 10/1997 |
| JP | 2007-292974 | 11/2007 |
| JP | 2012-155141 | 8/2012 |

* cited by examiner

*Primary Examiner* — Clayton E LaBalle
*Assistant Examiner* — Kevin Butler
(74) *Attorney, Agent, or Firm* — Oblon, McClelland, Maier & Neustadt, L.L.P.

(57) ABSTRACT

A developer amount detector to detect an amount of developer inside a developer container includes a light-emitting element; a light-receiving element; a first light guide including a first end disposed to face the light-emitting element and a second end disposed inside the developer container, covered with a translucent cover including a light-emitting face; a second light guide including a first end disposed to face the light-receiving element, a second end disposed inside the developer container, covered with a translucent cover including a light-receiving face to face the light-emitting face across a gap; and a cleaner including a sliding portion to slidingly contact the light-emitting face and the light-receiving face. The cover of each of the first and second light guides includes a material lower in chargeability with the sliding portion than a material of a body of each of the first and second light guides.

20 Claims, 8 Drawing Sheets

DEVELOPER AMOUNT DETECTOR, DEVELOPING DEVICE, PROCESS UNIT, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-236185, filed on Nov. 14, 2013, in the Japan Patent Office, the entire disclosure of which is hereby incorporated by reference herein.

BACKGROUND

1. Technical Field

Embodiments of the present invention generally relate to a developer amount detector, a developing device, a process unit, and an image forming apparatus, such as a copier, a printer, a facsimile machine, or a multifunction peripheral (i.e., a multifunction machine) including at least two of these functions.

2. Description of the Related Art

Electrophotographic image forming apparatuses, such as copiers, printers, facsimile machines, and multifunction peripherals (MFPs) having at least two of copying, printing, facsimile transmission, plotting, and scanning capabilities, include a developing device to develop latent images on a latent image bearer such as a photosensitive drum or a photoconductor drum. Typically, developing devices include a toner containing compartment to contain toner and a developing roller to supply toner contained in the toner containing compartment to the photosensitive drum. As the developing roller supplies toner from the toner containing compartment to the photosensitive drum, an electrostatic latent image on the photosensitive drum is developed.

To reduce the size and cost of developing devices, toner may be contained not only inside the developing device but also in a cartridge (i.e., a toner container) from which toner is supplied to the developing device. This configuration is becoming a mainstream at present. In this case, the amount of toner in the developing device is detected, and the developing device is replenished with toner supplied from the cartridge as the amount therein decreases. At that time, if the amount of toner supplied from the cartridge to the developing device is extremely large, there is a risk that powder pressure inside the device rises to cause toner to scatter out from a supply inlet. By contrast, if the amount of toner supplied from the cartridge to the developing device is extremely small, there is a risk that the amount of toner supplied to the developing roller, and further to the photosensitive drum, becomes insufficient. In either case, image quality degradation or leak of toner can arise, and thus the quality of printing is affected adversely. Accordingly, to secure the image quality, it is preferred to accurately detect the amount of toner inside the developing device and supply toner from the cartridge to the developing device reliably and quantitatively. Detecting the amount of toner remaining accurately and supplying toner to the developing device at proper timing are desirable particularly in compact developing devices since an inner volume of the toner containing compartment is smaller in the compact developing device.

SUMMARY

An embodiment of the present invention provides a developer amount detector to detect an amount of developer inside a developer container. The developer amount detector includes a light-emitting element; a light-receiving element; a first light guide including a first end disposed to face the light-emitting element and a second end disposed inside the developer container; a second light guide including a first end disposed to face the light-receiving element and a second end disposed inside the developer container; and a cleaner. A translucent cover is provided to the second end of each of the first light guide and the second light guide. The cover to cover the second end of the first light guide includes a light-emitting face, and the cover to cover the second end of the second light guide includes a light-receiving face to face the light-emitting face across a gap. The cleaner includes a sliding portion to slidingly contact the light-emitting face and the light-receiving face to remove developer adhering to the light-emitting face and the light-receiving face. The cover of each of the first light guide and the second light guide includes a material lower in chargeability with the sliding portion than a material of a body of each of the first light guide and the second light guide.

In another embodiment, a developing device includes the developer container, a developer conveying member disposed inside the developer container to transport developer by rotation, and the developer amount detector described above. The cleaner is attached to the developer conveying member, and the sliding portion cleans the light-emitting face and the light-receiving face as the clearer rotates together with the developer conveying member.

In yet another embodiment, a process unit includes the developing device described above.

In yet another embodiment, an image forming apparatus includes the process unit described above.

Yet another embodiment provide a developer amount detector to detect an amount of developer inside a developer container. The developer amount detector includes a light-emitting element, a light-receiving element, a first light guide, a second light guide, and a cleaner. The first light guide includes a first end disposed to face the light-emitting element, a second end disposed inside the developer container, and a translucent cover that covers the second end of the first light guide and includes a light-emitting face. The second light guide includes a first end disposed to face the light-receiving element, a second end disposed inside the developer container, and a translucent cover that covers the second end of the second light guide and includes a light-receiving face to face the light-emitting face across a gap. The cleaner includes a sliding portion to slidingly contact the light-emitting face and the light-receiving face to remove developer adhering thereto. The cover of the first light guide is lower in chargeability with the sliding portion than a body of the first light guide, and the cover of the second light guide is lower in chargeability with the sliding portion than a body of the second light guide.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
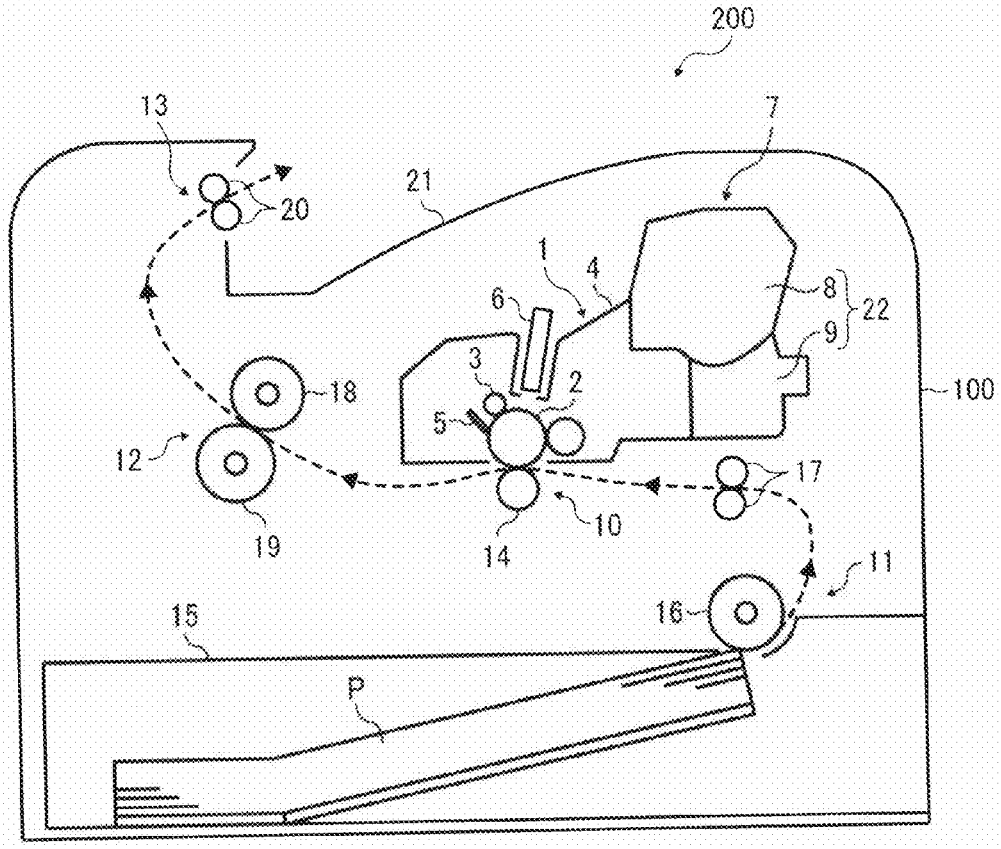
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described.

FIG. 1 is a schematic view of an image forming apparatus 200 according to the present embodiment. Referring to FIG. 1, a configuration and operation of the image forming apparatus 200 are described below.

The image forming apparatus 200 shown in FIG. 1 is a monochrome image forming apparatus, for example. A process unit 1 serving as an image forming unit is removably installed in an apparatus body 100 of the image forming apparatus 200. The process unit 1 includes a photoconductor 2 serving as an image bearer to bear images, a charging roller 3 serving as a charging member to charge a surface of the photoconductor 2, a developing device 4 to develop a latent image on the photoconductor 2, and a cleaning blade 5 serving as a cleaning device to clean the surface of the photoconductor 2. The image forming apparatus 200 further includes a light-emitting diode (LED) head array 6 serving as an exposure device to expose the surface of the photoconductor 2, disposed facing the photoconductor 2.

Additionally, a toner cartridge 7 serving as a developer container is removably mounted in the process unit 1. The toner cartridge 7 includes a container body 22 provided with a toner containing compartment 8 to contain toner (i.e., developer) supplied to the developing device 4. The toner cartridge 7 according to the present embodiment further includes, integrally as a part of the toner cartridge 7, a toner collecting chamber 9 to collect the toner removed by the cleaning blade 5. It is to be noted that one-component developer consisting essentially of toner (toner particles) without carrier is used in the present embodiment. Additionally, for example, toner used in the present embodiment is polyester toner including polyester resin mother particles.

In addition to the process unit 1, the image forming apparatus 200 includes a sheet feeder 11, a transfer device 10 to transfer images onto sheets of recording media fed by the sheet feeder 11, a fixing device 12 to fix images on the sheets, and a discharge device 13 to discharge the sheets outside the image forming apparatus 200.

The transfer device 10 includes a transfer roller 14 serving as a transfer member. The transfer roller 14 abuts against the photoconductor 2 in a state in which the process unit 1 is installed in the apparatus body 100, and a contact portion therebetween is called a transfer nip. Additionally, the transfer roller 14 is electrically connected to a power source and receives a predetermined amount of voltage that is either direct-current (DC) voltage, alternating current (AC) voltage, or including both.

The sheet feeder 11 includes a sheet feeding tray 15 to contain sheets P and a sheet feeding roller 16 to transport the sheets P. Downstream from the sheet feeding roller 16 in a direction in which the sheet P is transported, a pair of registration rollers 17 is provided as timing rollers to transport the sheet P timely to the transfer nip. It is to be noted that "recording media" used here include, in addition to standard copy paper, heavy paper, post cards, thin paper such as tracing paper, coated paper, art paper, and special purpose sheets. Additionally, overhead projector (OHP) sheets or films may be used as the recording media.

The fixing device 12 includes a fixing roller 18 serving as a fixing member and a pressure roller 19 serving as a pressure member. The fixing roller 18 is heated by a heat source such as a heater. The pressure roller 19 is pressed against the fixing roller 18, and an abutment portion therebetween serves as a fixing nip.

The discharge device 13 includes a pair of discharge rollers 20. An upper face of the apparatus body 100 is partly recessed into a discharge tray 21, and the sheet P discharged by the discharge rollers 20 is stacked on the discharge tray 21.

Referring to FIG. 1, image forming operation according to the present embodiment is described below.

When image formation is started, the photoconductor 2 is rotated, and the charging roller 3 uniformly charges the surface of the photoconductor 2 to a predetermined polarity. Then, the LED head array 6 directs a laser beam onto the charged surface of the photoconductor 2 according to, for example, image data captured by a reading unit or transmitted from computers. Thus, an electrostatic latent image is formed on the photoconductor 2. The electrostatic latent image on the photoconductor 2 is developed into a toner image with toner supplied by the developing device 4.

Additionally, when image formation is started, the sheet feeding roller 16 rotates, thereby transporting the sheet P from the sheet feeding tray 15. Then, the registration rollers 17 stop the sheet P temporarily. The registration rollers 17 resume rotation at a predetermined timing to transport the sheet P to the transfer nip, timed to coincide with the arrival of the toner image on the photoconductor 2.

At that time, a transfer bias voltage whose polarity is opposite a toner charge polarity of the toner image on the photoconductor 2 is applied to the transfer roller 14, and thus a transfer electrical field is generated in the transfer nip. The transfer electrical field transfers the toner image from the photoconductor 2 onto the sheet P (i.e., a transfer process). After the transfer process, the cleaning blade 5 removes toner remaining on the photoconductor 2, and the removed toner is collected in the toner collecting chamber 9 inside the toner cartridge 7.

The sheet P carrying the toner image is transported to the fixing device 12, and the toner image is fixed thereon with heat and pressure while the sheet P passes through the fixing nip between the fixing roller 18 and the pressure roller 19. Then, the pair of discharge rollers 20 discharges the sheet P onto the discharge tray 21.

Figure 2:
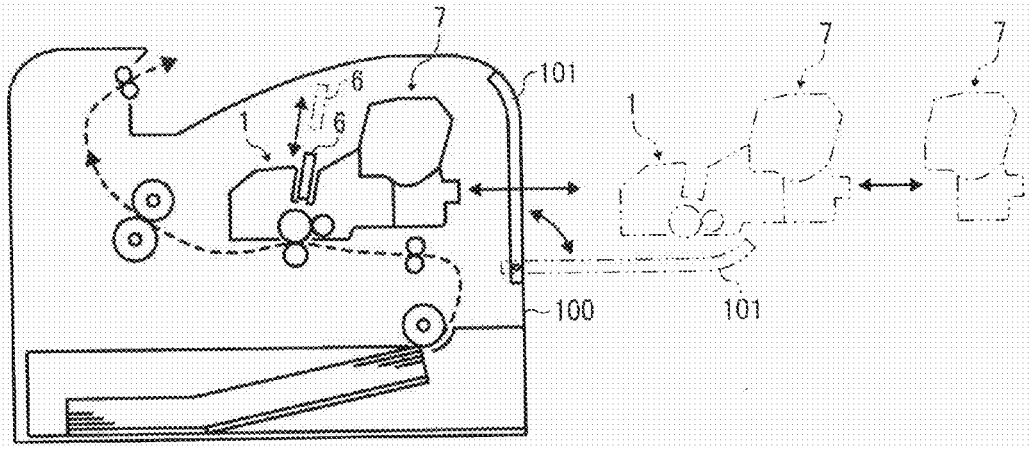
FIG. 2 illustrates installation and removal of a process unit in and from the image forming apparatus shown in FIG. 1.

Referring to FIG. 2, installation and removal of the process unit 1 is described below.

In the configuration shown in FIG. 2, an openable and closable cover 101 is provided on a rear side of the apparatus body 100. In a state in which the cover 101 is open, the LED head array 6 is lifted via a link assembly. With this configuration, when the cover 101 is open, the process unit 1 can be removed from the rear side while avoiding interference with the LED head array 6. Additionally, in the present embodiment, the process unit 1 and the toner cartridge 7 attached thereto can be removed together at a time. Additionally, the toner cartridge 7 can be attached to the process unit 1 and removed therefrom in both states in which the process unit 1 is installed in the apparatus body 100 and removed therefrom.

Figure 3:
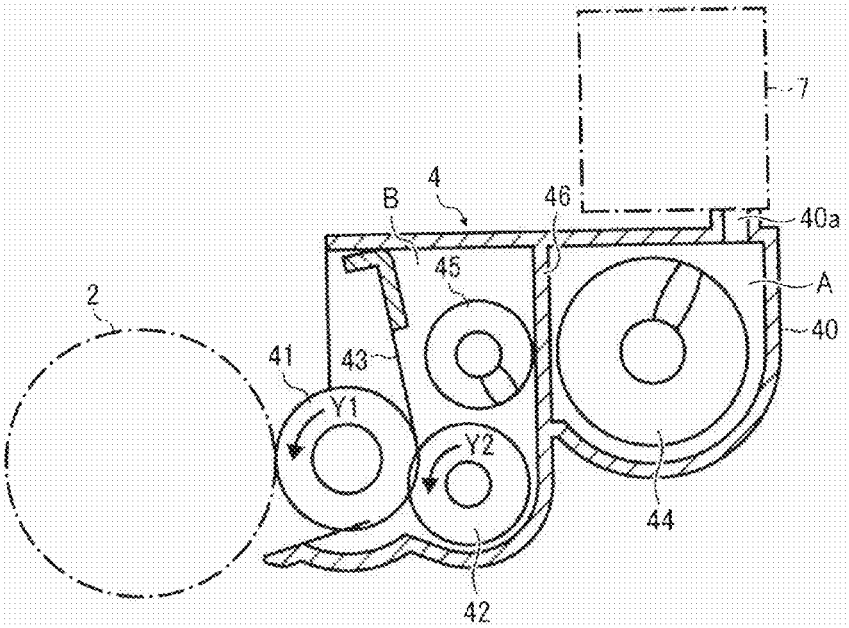
FIG. 3 is a schematic cross-sectional view illustrating a configuration of a developing device according to an embodiment.

FIG. 3 is a schematic cross-sectional view of the developing device 4.

As shown in FIG. 3, the developing device 4 according to the present embodiment includes a development housing 40 serving as a toner container (i.e., a developer container) to contain toner (i.e., developer), a developing roller 41 serving as a developer bearer, a supply roller 42 serving as a developer supply member to supply toner to the developing roller 41, a doctor blade 43 serving as a developer regulator to adjust the amount of toner carried on the developing roller 41, and first and second developer conveyance members 44 and 45 to transport toner.

The developing roller 41 rotates counterclockwise in FIG. 3 as indicated by arrow Y1 shown in FIG. 3 and transports toner carried thereon to a position facing the doctor blade 43 and a position facing the photoconductor 2.

Additionally, the supply roller 42 abuts against the developing roller 41 and supplies toner in the development housing 40 to a surface (an outer layer) of the developing roller 41 by rotating in a direction indicated by arrow Y2 (counterclockwise in FIG. 3) counter to the direction of rotation of the developing roller 41. It is to be noted that, in the present embodiment, the ratio of rotational frequency of the supply roller 42 to that of the developing roller 41 is 1 so that toner can be supplied reliably.

The doctor blade 43 is disposed so that its end (on a free end side) abuts against the surface of the developing roller 41, and a nip therebetween is called a regulation nip. While the toner supplied to the developing roller 41 from the supply roller 42 passes through the regulation nip between the developing roller 41 and the doctor blade 43, the amount of toner is adjusted. Simultaneously, toner is charged through friction.

Additionally, the toner cartridge 7 serving as the toner container to contain refill toner is provided above the development housing 40 and removably attached thereto. The developing device 4 and the toner cartridge 7 may be integrated into a single unit.

A toner inlet 40*a* (i.e., a supply inlet) is in an upper portion of the development housing 40 to supply toner from the toner cartridge 7 to the development housing 40. Toner is supplied to the development housing 40 according to detection results by a developer amount detector 50 (shown in FIG. 4) described below and configured to detect the amount of toner remaining in the development housing 40. Specifically, when a toner amount detector 50, serving as a developer amount detector, detects that the amount of toner inside the development housing 40 is at or below a threshold, the toner cartridge 7 is driven for a predetermined period of time, thereby supplying a predetermined amount of toner to the development housing 40.

A partition 46 extending substantially parallel to the axial direction of the developing roller 41 divides, but not completely, the development housing 40 into a first compartment A in which the toner inlet 40*a* is positioned and a second compartment B in which the developing roller 41, the doctor blade 43, and the like are provided. In the present embodiment, the partition 46 stands vertically or substantially vertically, and the first and second compartments A and B are arranged horizontally or substantially horizontally. The first and second developer conveyance members 44 and 45 are positioned in the first and second compartments A and B, respectively.

Figure 4:
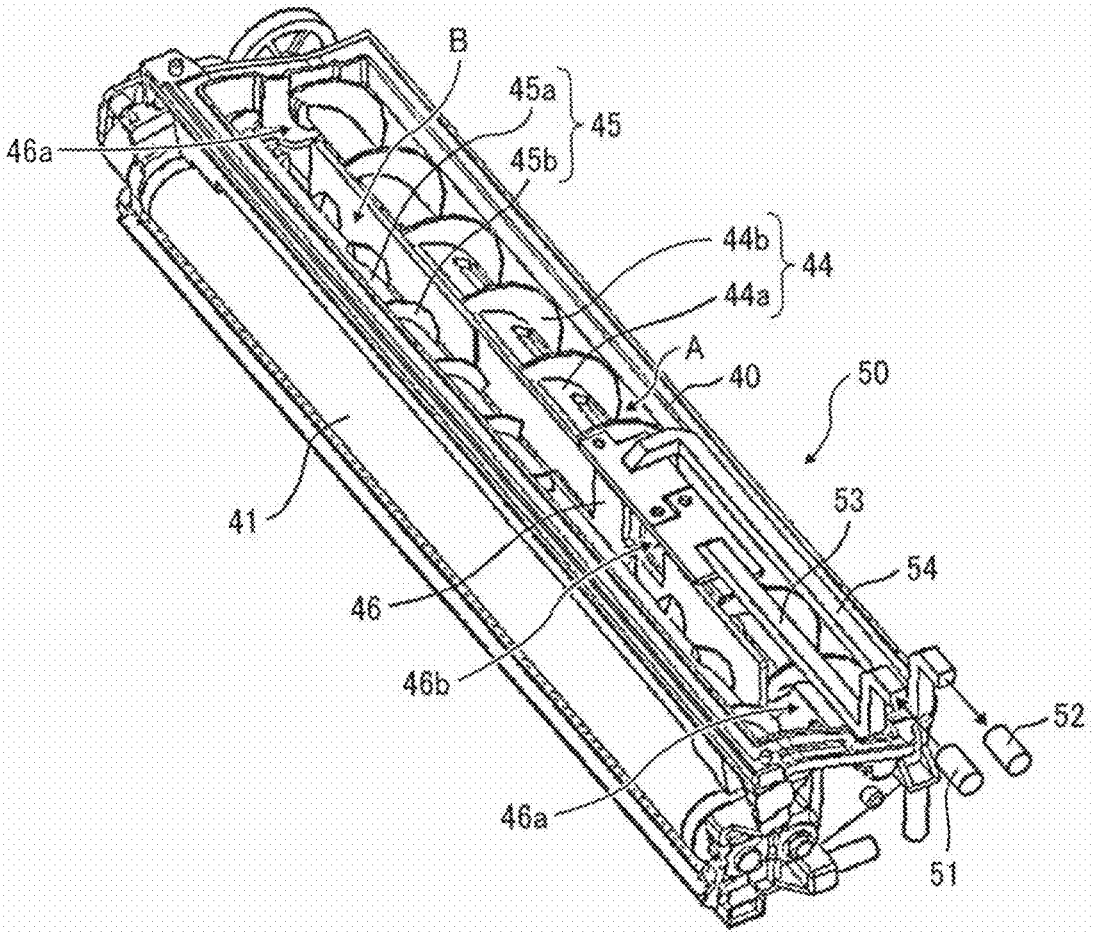
FIG. 4 is a perspective view of the developing device shown in FIG. 3, with a top side of a development housing removed.
Figure 6:
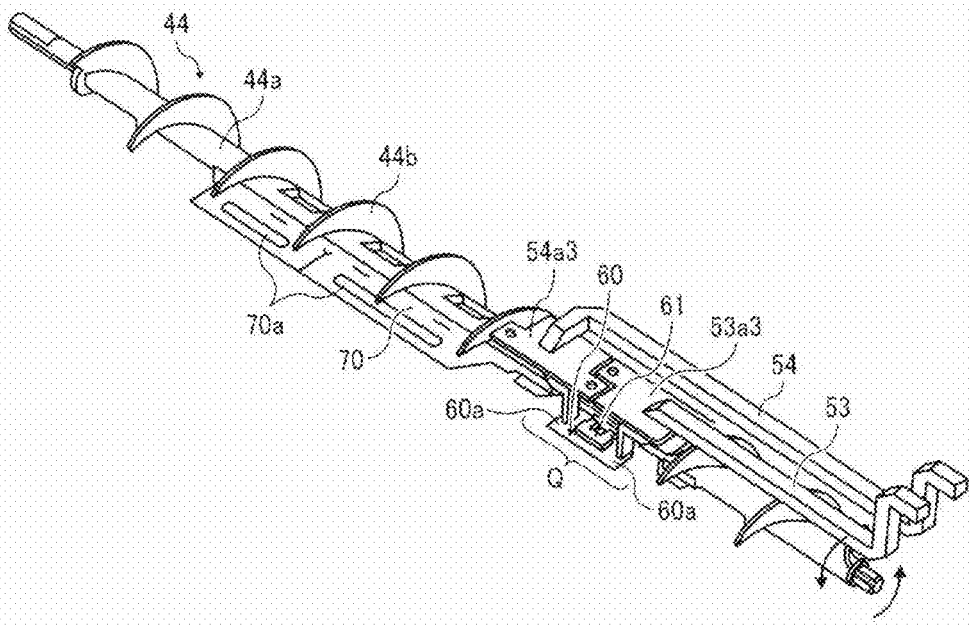
FIG. 6 is a perspective view illustrating relative positions of a first developer conveyance member and first and second light guides according to an embodiment.

As shown in FIG. 4, the first and second developer conveyance members 44 and 45 are positioned substantially facing each other via the partition 46 that divides the first compartment A and the second compartment B from each other. The partition 46 is shorter than the developing roller 41 in the axial direction of the developing roller 41. At both ends of the partition 46, main communication openings 46*a* are provided, and a sub-communication opening 46*b* is provided in an intermediate portion of the partition 46 between the main communication openings 46*a*. The first compartment A and the second compartment B can communicate with each other via the main communication openings 46*a* and the sub-communication opening 46*b*. The first and second developer conveyance members 44 and 45 transport toner axially by rotation. In the present embodiment, the first developer conveyance member 44 can be a screw including a rotation shaft 44*a* and a conveyance blade 44*b* spirally provided to an outer circumference of the rotation shaft 44*a*. Similarly, the second developer conveyance member 45 can be a screw including a rotation shaft 45*a* and a conveyance blade 45*b* spirally provided to an outer circumference of the rotation shaft 45*a*. As shown in FIG. 6, in the axial direction, the first developer conveyance member 44 includes a partial range Q where the conveyance blade 44*b* is not present, and an end (a light-emitting face P1 shown in FIG. 7) of the first light guides 53 and an end (a light-receiving face P2 shown in FIG. 7) of the second light guide 54 facing each other are disposed within the partial range Q.

The toner amount detector 50 is provided in the first compartment A and has a detection area (light transmission path L shown in FIG. 7) adjacent to the sub-communication opening 46*b* in the partition 46. As shown in FIG. 6, the toner amount detector 50 includes a light-emitting element 51 and a light-receiving element 52 that are optical elements, and first and second light guides 53 and 54 that are provided to the development housing 40. The light-emitting element 51 and the light-receiving element 52 are disposed outside the development housing 40 and attached, for example, to the apparatus body 100.

Figure 5:
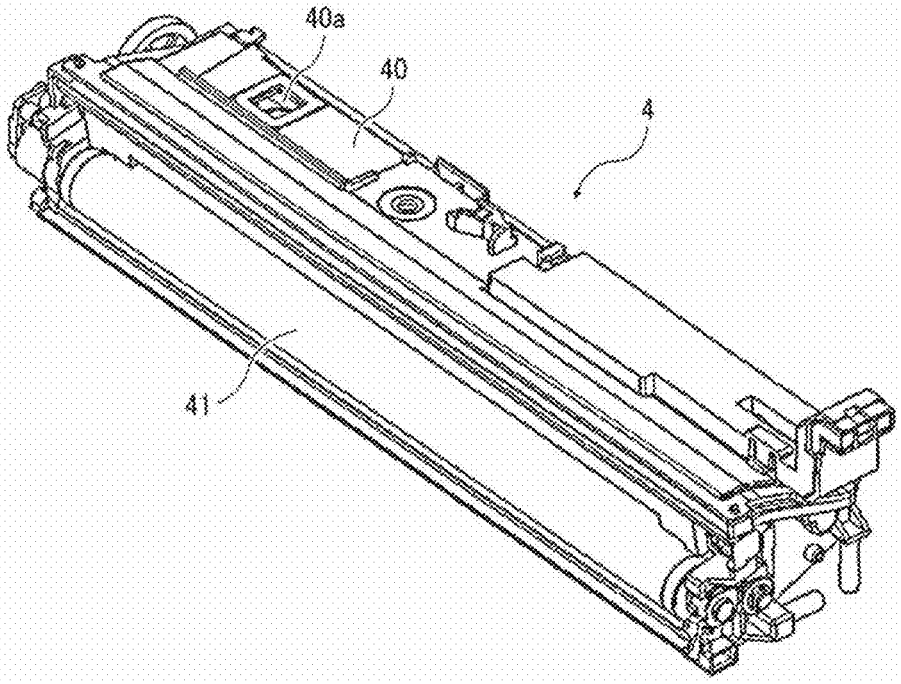
FIG. 5 is a perspective view of the developing device shown in FIG. 3, with the top side closed.
Figure 7:
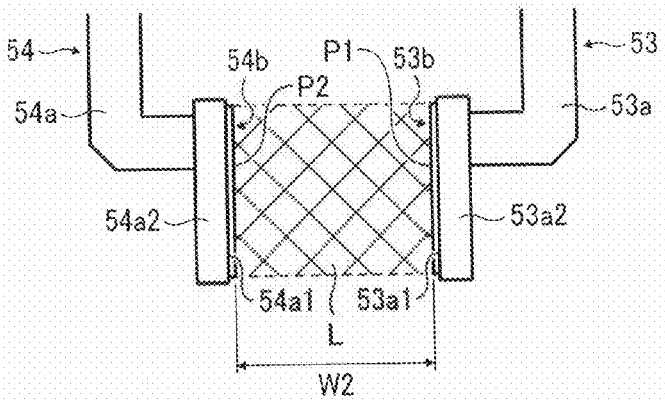
FIG. 7 is a side view of a light transmission path between a light-emitting face and a light-receiving face of the first and second light guides shown in FIG. 6.

In the present embodiment, each of the first and second light guides 53 and 54 is introduced into the first compartment A from above as shown in FIGS. 4 and 5. A first end of the first light guide 53 is exposed outside the development housing 40 and is positioned to face the light-emitting element 51. A second end of the first light guide 53 is positioned in the first compartment A inside the development housing 40. By contrast, a first end of the second light guide 54 is exposed from the development housing 40 and is positioned to face the light-receiving element 52. A second end of the second light guide 54 is disposed inside the first compartment A of the development housing 40. As shown in FIG. 7, the second end of the first light guide 53 includes the light-emitting face P1, and the second end of the second light guide 54 includes the light-receiving face P2. The light-emitting face P1 and the light-receiving face P2 face each other across a predetermined gap in the longitudinal direction of the partition 46 (i.e., the axial direction of the first and second developer conveyance members 44 and 45).

The first light guide 53 includes a cover 53*b* to cover a part of a body 53*a* of the first light guide 53. The second light guide 54 includes a cover 54*b* to cover a part of a body 54*a* of the second light guide 54.

The bodies 53*a* and 54*a* are main portions of the first and second light guides 53 and 54, respectively. A first end of the body 53*a* of the first light guide 53 faces the light-emitting element 51, and a second end of the body 53*a* includes a flat face 53*a*1. A first end of the body 54*a* of the second light guide 54 faces the light-receiving element 52, and a second end of the body 54*a* includes a flat face 54*a*1. The flat faces 53*a*1 and 54*a*1 of the bodies 53*a* and 54*a* are perpendicular to the axial direction of the first and second developer conveyance members 44 and 45 and face each other in the axial direction. In the present embodiment, the body 53*a* includes an extended portion 53*a*2 extending downward and provided to the second end of the body 53*a*. Similarly, the body 54*a* includes an extended portion 54*a*2 extending downward and provided to the second end of the body 54*a*. The extended portions 53*a*2 and 54*a*2 respectively include the flat faces 53*a*1 and 54*a*1 facing each other.

Referring to FIG. 6, planar attachment portions 53*a*3 and 54*a*3 provided to intermediate portions of the bodies 53*a* and 54*a* are secured to the development housing 40. The bodies 53*a* and 54*a* can be made of a translucent material, and materials usable therefor include polycarbonate resin, acrylic resin, and the like, for example, and further include optical glass and optical fibers. In the present embodiment, the bodies 53*a* and 54*a* are made of polycarbonate resin by monolithic molding, for example.

Figure 8:
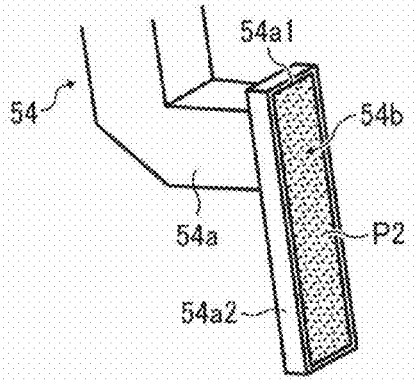
FIG. 8 is a perspective view illustrating an area adjacent to the light-receiving face of the second light guide shown in FIG. 7.

FIG. 8 illustrates the light-receiving face P2 of the second light guide 54 and an adjacent portion. It is to be noted that, although not shown, the light-emitting face P1 of the first light guide 53 and an adjacent portion are similar thereto.

The covers 53*b* and 54*b* partly cover the bodies 53*a* and 54*a*, respectively. Specifically, as shown in FIGS. 7 and 8, the cover 53*b* covers the flat face 53*a*1 at the second end (i.e., the extended portion 53*a*2) of the body 53*a* and serves as the light-emitting face P1 of the first light guide 53. Similarly, the cover 54*b* covers the flat face 54*a*1 at the second end (i.e., the extended portion 54*a*2) of the body 54*a* and serves as the light-receiving face P2 of the second light guide 54.

In the present embodiment, the covers 53*b* and 54*b* are made of a translucent material that is lower in a chargeability with a material (polyethylene terephthalate or PET in the present embodiment) of sliding portions 60*a* of the cleaner 60 than the material of the bodies 53*a* and 54*a* (polycarbonate resin in the present embodiment). For example, polyethylene or polyester resin (for example, PET) can be used for the covers 53*b* and 54*b*.

It is to be noted that the term "chargeability with the material of the sliding portions 60*a*" used here means the degree of electrical charges of the translucent material caused by sliding contact with the sliding portions 60*a*, and chargeability can be measured according to JIS (Japanese Industrial Standards) C 61340-2-2:2013. Additionally, the term "translucent material" used here means a material that transmits light regardless of whether it is chromatic or achromatic.

For example, the covers 53*b* and 54*b* include translucent film and are stuck on the flat faces 53*a*1 and 54*a*1 of the bodies 53*a* and 54*a*, respectively. In the present embodiment, the covers 53*b* and 54*b* are translucent tape each including translucent film and an adhesive layer on a back side of the translucent film. A front side of the translucent film opposite the adhesive layer serves as the light-emitting face P1 or the light-receiving face P2. As well as the translucent film, the adhesive layer of the translucent tape is translucent. For example, the translucent tape can be polyethylene tape including polyethylene film and an adhesive layer on a back side of the polyethylene film. Alternatively, PET tape or so-called cellophane tape can be used as the translucent tape.

It is preferable that the covers 53*b* and 54*b* cover the flat faces 53*a*1 and 54*a*1 of the bodies 53*a* and 54*a* entirely. However, when the covers 53*b* and 54*b* are made of translucent film or translucent tape and equal in size to the flat faces 53*a*1 and 54*a*1, it is practically unfeasible to stick the covers 53*b* and 54*b* thereto without protruding from the flat faces 53*a*1 and 54*a*1. Accordingly, in the present embodiment, as shown in FIG. 8, the covers 53*b* and 54*b* are slightly smaller than the flat faces 53*a*1 and 54*a*1, and entire peripheries thereof are disposed inside outer edges of the flat faces 53*a*1 and 54*a*1. In this case, sticking the covers 53*b* and 54*b* to the flat faces 53*a*1 and 54*a*1 can be easier, and the amount or size of the covers 53*b* and 54*b* can be reduced, thereby reducing the cost.

A thickness of the translucent film is preferably about 10 μm or greater and more preferably about 50 μm or greater. Additionally, the thickness of the translucent film is preferably about 200 μm or smaller, more preferably, about 150 μm or smaller, and, yet more preferably, about 100 μm or smaller. Additionally, the front side of the translucent film (the light-emitting face P1 or the light-receiving face P2) is smaller in friction coefficient than the flat faces 53*a*1 and 54*a*1 of the bodies 53*a* and 54*a*.

Figure 9:
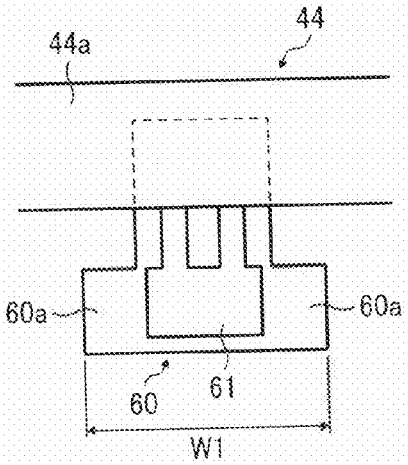
FIG. 9 is a plan view of an area adjacent to a cleaner and the first developer conveyance member shown in FIG. 6.

As shown in FIG. 9, the cleaner 60 is provided to the rotation shaft 44*a* of the first developer conveyance member 44. The cleaner 60 is pressed by a pressing member 61 from a back side in the direction of rotation of the first developer conveyance member 44, and the pressing member 61 is provided to the rotation shaft 44*a* as well. The cleaner 60 includes the sliding portions 60*a* that slidingly contact the light-emitting face P1 of the first light guide 53 and the light-receiving face P2 of the second light guide 54. In the cleaner 60, at least the sliding portions 60*a* are flexible. For example, the sliding portions 60*a* include or are made of resin, more specifically, polyester resin. In the present embodiment, the sliding portion 60*a* is made of PET. In the present embodiment, the cleaner 60 is a single PET sheet.

In FIG. 9, reference character W1 represents a length of the cleaner 60 in the axial direction of the first developer conveyance member 44, more specifically, a length at an outer end of the cleaner 60 in the direction of diameter of the first developer conveyance member 44. In other words, the length W1 is a distance between ends of the sliding portions 60*a* in the axial direction of the first developer conveyance member 44. The length W1 is slightly longer than a distance W2 (shown in FIG. 7) between the light-emitting face P1 and the light-receiving face P2 in the axial direction. The W2 means a length of the light transmission path L. It is to be noted that the cleaner 60 is not oblique to the rotation shaft 44*a* (that is, parallels to a plane including the axial direction of the rotation shaft 44*a*) and is not capable of transporting developer axially, differently from the conveyance blade 44*b*.

As shown in FIG. 6, the first developer conveyance member 44 is further provided with a flexible agitation blade 70 to agitate toner. The agitation blade 70 is attached to the rotation shaft 44*a* upstream from the cleaner 60 in the toner conveyance direction. The agitation blade 70 is a flexible member and can be polyethylene terephthalate (PET) sheet. The agitation blade 70 is integrated with the cleaner 60 in the present embodiment. Alternatively, the agitation blade 70 may be separate from the cleaner 60. With the agitation blade 70, mixing of the supplied toner with the toner existing in the development housing 40 can be promoted. It is to be noted that the agitation blade 70 is not oblique to the rotation shaft 44*a* and is not capable of transporting toner axially differently from the conveyance blade 44*b*. Additionally, an opening 70*a* (such as a slit) to let toner to pass through may be provided to the agitation blade 70 to alleviate the stress on the agitation blade 70 given by the toner when the agitation blade 70 rotates.

The first and second developer conveyance members 44 and 45 rotate to transport toner in the opposite directions. The toner transported by the first and second developer conveyance members 44 and 45 to axial ends of the first and second compartments A and B is not transported further in the axial direction but is transported through the main communication openings 46*a* to the other compartment (from the first compartment A to the second compartment B, or from the second compartment B to the first compartment A). Then, toner is transported by the first and second developer conveyance members 44 and 45 in the first and second compartments A and B to the opposite ends, respectively, after which toner is transported again through the main communication openings 46*a* to the other compartment. Toner can be circulated between the first compartment A and the second compartment B by repeating this operation. The first and second compartments A and B together constitute a toner conveyance route.

Simultaneously, the toner amount detector 50 detects the amount of toner remaining in the development housing 40. Specifically, the light emitted from the light-emitting element 51 enters the first end of the first light guide 53 and exits from the light-emitting face P1 at the second end of the first light guide 53. Then, the light exiting the light-emitting face P1 of the first light guide 53 passes through the light transmission path L (shown in FIG. 7), enters the light-receiving face P2 at the second end of the second light guide 54, and exits from the first end of the second light guide 54. Then, the light reaches the light-receiving element 52.

Figure 10:
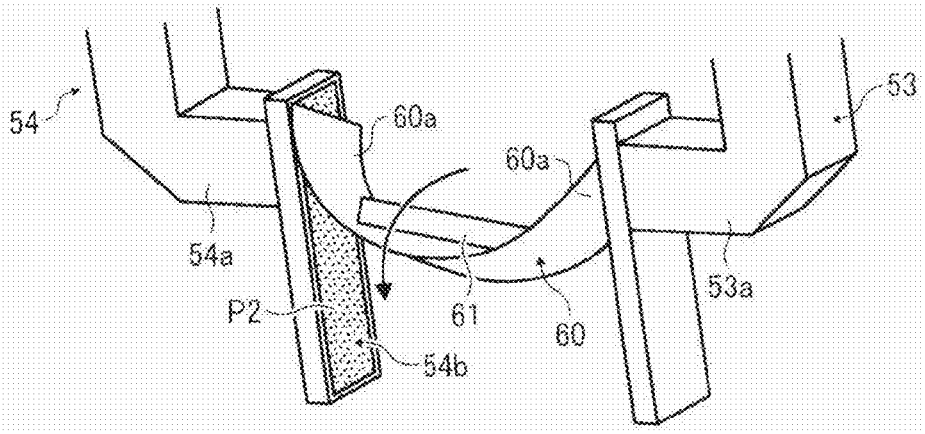
FIG. 10 is a perspective view of the cleaner shown in FIG. 9, being cleaning the light-emitting face and the light-receiving face.

At that time, as the first developer conveyance member 44 rotates, the cleaner 60 secured thereto rotates. Then, the sliding portions 60*a* slidingly contact the light-emitting face P1 and the light-receiving face P2 while being curved. With this action, toner adhering to the light-emitting face P1 and the light-receiving face P2 are scraped off, and transmission of light from the light-emitting face P1 to the light-receiving face P2 can be maintained reliably. At that time, as shown in FIG. 10, the cleaner 60 passes between the light-emitting face P1 and the light-receiving face P2 while the pressing member 61 presses the intermediate portion (hereinafter also "axial intermediate portion") of the cleaner 60 in the axial direction (the portion pressed by the pressing member 61 is at the end in the direction perpendicular to the axial direction). Thus, the axial intermediate portion at the end of the cleaner 60 curves to protrude toward a front side in the direction of rotation of the developer conveyance member 44. Accordingly, the sliding portions 60*a* can contact the light-emitting face P1 and the light-receiving face P2 entirely.

Additionally, as the cleaner 60 rotates, the toner inside the development housing 40 is agitated up and passes between the light-emitting face P1 and the light-receiving face P2. Since the toner passing between the light-emitting face P1 and the light-receiving face P2 blocks the light transmission path L, light does not reach the light-receiving element 52. In a state where the amount of toner in the development housing 40 is sufficient, the amount of toner agitated up at that time is relatively large, and the light transmission path L is blocked by the toner for a relatively long time. By contrast, as toner is consumed in printing and the amount of toner in the development housing 40 decreases, the amount of toner agitated up at that time becomes smaller. Then, the time period during which the light transmission path L is blocked is shorter. Accordingly, the amount of toner in the development housing 40 can be detected based on the time period (hereinafter "light-receiving time") during which the amount of light received by the light-receiving element 52 is at or greater than a reference value. Specifically, when the light-receiving time of the light-receiving element 52 is shorter than a predetermined period, for example, a controller of the image forming apparatus 200 determines that the amount of toner in the development housing 40 is sufficient. By contrast, when the light-receiving time of the light-receiving element 52 exceeds the predetermined period, the controller determines that the amount of toner in the development housing 40 is insufficient. In this case, the toner cartridge 7 is driven for the predetermined period of time, thereby supplying toner to the development housing 40.

The cleaner 60 slidingly contacts the light-emitting face P1 and the light-receiving face P2 and removes toner adhering thereto to inhibit degradation in detection accuracy of the toner amount detector 50. The light-emitting face P1 and the light-receiving face P2, however, can be charged electrostatically by sliding contact with the cleaner 60. Then, there is a risk that the sliding contact causes toner (developer) to adheres to the light-emitting face P1 and the light-receiving face P2, thus degrading the detection accuracy on the contrary. Thus, there is a concern that the light-emitting face P1 and the light-receiving face P2 are charged while the sliding portions 60*a* of the cleaner 60 slidingly contact the light-emitting face P1 and the light-receiving face P2.

In view of the foregoing, in the present embodiment, the second ends of the bodies 53*a* and 54*a* of the first and second light guides 53 and 54 are covered with the covers 53*b* and 54*b*, and the covers 53*b* and 54*b* serve as the light-emitting face P1 and the light-receiving face P2. Accordingly, a suitable material can be used for each of the bodies 53*a* and 54*a* and the covers 53*b* and 54*b*. Therefore, charging of the light-emitting face P1 and the light-receiving face P2 provided to the covers 53*b* and 54*b* are suppressed when the covers 53*b* and 54*b* are lower in chargeability with of the sliding portion 60*a* (made of PET, for example) than the bodies 53*a* and 54*a* (made of polycarbonate resin, for example) In a case where the sliding portions 60*a* are made of polyester resin (PET in particular) as in the present embodiment, charging by sliding contact therebetween can be suppressed by using polyethylene for the covers 53*b* and 54*b*. Additionally, in a case where polyester toner is used as in the present embodiment, charging by sliding contact between toner and the light-emitting face P1 and the light-receiving face P2 are suppressed by using polyethylene for the covers 53*b* and 54*b*. That is, to reliably suppress charging of the light-emitting face P1 and the light-receiving face P2, it is advantageous to use the sliding portions 60*a* made of PET, the covers 53*b* and 54*b* made of polyethylene, and polyester toner.

Although the toner inside the development housing 40 is charged negatively, it is possible that the toner once carried on the developing roller 41 and regulated by the regulation blade 43 is charged positively. Inhibiting charging of the light-emitting face P1 and the light-receiving face P2 as described above is also advantageous in inhibiting positively charged toner as well as negatively charged toner from adhering to the light-emitting face P1 and the light-receiving face P2.

By contrast, flexibility in selecting the material of the bodies 53*a* and 54*a* can increase since it is not necessary to consider generation of charges by friction with sliding portions 60*a* of the cleaner 60 and toner. In the present embodiment, the bodies 53*a* and 54*a* can be made of polycarbonate resin that excels in transmitting light as described above. Since it is not necessary to reduce the friction coefficient and the surface roughness of the second ends of the bodies 53*a* and 54*a*, required molding accuracy thereof is lower. Additionally, although acrylic resin charges very easily and thus is typically considered less suitable for light guide despite its capability to transmit light, acrylic resin can be used for the bodies 53*a* and 54*a* by forming the light-emitting face P1 and the light-receiving face P2 with the covers 53*b* and 54*b*.

Additionally, even if surface roughness of the flat faces 53*a*1 and 54*a*1 is relatively large, the smooth light-emitting face P1 and the smooth light-receiving face P2 can be attained by applying, as in the present embodiment, translucent film serving as the covers 53*b* and 54*b* to the flat faces 53*a*1 and 54*a*1 at the second ends of the bodies 53*a* and 54*a*. Additionally, the covers 53*b* and 54*b* can be easily secured to the bodies 53*a* and 54*a* when the covers 53*b* and 54*b* are pieces of translucent tape including the adhesive layer on the back of translucent film. Further, the adhesive layer of the translucent tape can fill in minute recesses in the flat faces 53*a*1 and 54*a*1 of the bodies 53*a* and 54*a* and accordingly inhibit diffuse reflection of light, thereby increasing the amount of light transmitted. Accordingly, detection accuracy is enhanced.

Additionally, when the translucent film serving as the covers 53*b* and 54*b* has a thickness of 10 μm or greater as described above, abrasion resistance to sliding contact with the sliding portions 60*a* of the cleaner 60 increases. Additionally, when the thickness of the translucent film is 200 μm or smaller, steps at boundaries between the flat faces 53*a*1 and 54*a*1 and the covers 53*b* and 54*b* are smaller. This configuration can reduce a risk that the sliding portions 60*a* of the cleaner 60 are caught on the steps and cleaning becomes insufficient.

It is to be noted that numerous additional modifications to the above-described embodiment and variations are possible. It is therefore to be understood that, within the scope of the appended claims, the disclosure of this patent specification may be practiced otherwise than as specifically described herein.

Figure 11:
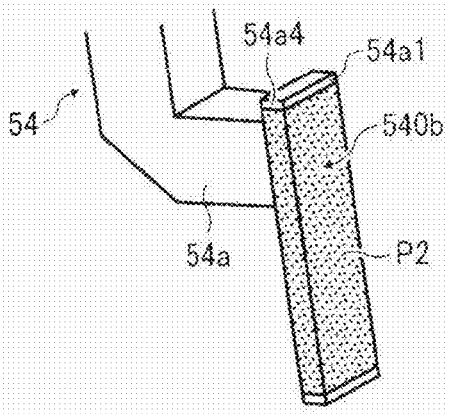
FIG. 11 is a perspective view illustrating an area adjacent to a light-receiving face of a second light guide according to another embodiment.

For example, the covers 53*b* and 54*b* may be applied to the flat faces 53*a*1 and 54*a*1 in a manner different from the description above. For example, FIG. 11 illustrates a cover 540*b* greater in lateral size than the cover 54*b* shown in FIGS. 8 and 10 as another embodiment. The cover 540*b* covers the flat face 54*a*1 of the second light guide 54 and further covers a side face 54*a*4 adjacent to the flat face 54*a*1 in the lateral direction in FIG. 11. The cover 540*b* may extend to side faces on both sides of the flat face 54*a*1.

Although the flat face 53*a*1 of the first light guide 53 is not illustrated in FIG. 11, a cover greater in lateral size than the cover 53*b* may be applied to the flat face 53*a*1 to extend to one or both side faces adjacent to the flat face 53*a*1 similarly. Since the flat faces 53*a*1 and 54*a*1 are covered entirely to the ends thereof, this configuration can reduce the steps (boundary between covered portions and portions not covered) on the flat faces 53*a*1 and 54*a*1. Accordingly, the sliding portion 60*a* of the cleaner 60 can be prevented from being caught on the step.

Further, although the cleaner 60 is a single PET sheet in the description above, the configuration of the cleaner 60 is not limited thereto. For example, out of the cleaner 60, the sliding portions 60*a* may be made of PET, and other portions may be separate therefrom.

Figure 12:
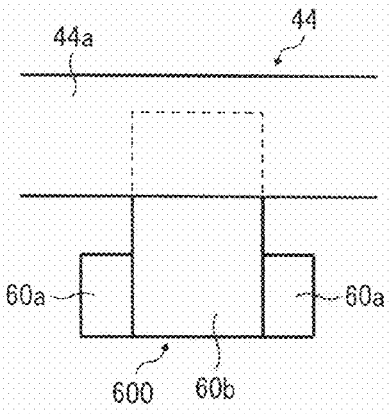
FIG. 12 is a plan view of an area adjacent to a cleaner and an adjacent area, according to another embodiment.

For example, FIG. 12 illustrates a cleaner 600 as another embodiment. The cleaner 600 includes a plate 60*b* and sliding portions 60*a* that are PET sheets provided to both sides of the plate 60*b* in the axial direction of the first developer conveyance member 44. The plate 60*b* can be made of stainless steel, for example. Alternatively, the cleaner 60 may include a plate and a resin coating on the plate. For example, polyethylene may be used as the resin coating.

Further, although the covers 53*b* and 54*b* are made of translucent tape in the description above, pieces of translucent film serving as the covers 53*b* and 54*b* may be bonded to the flat faces 53*a*1 and 54*a*1 using glue. Additionally, the covers 53*b* and 54*b* are not limited to those using translucent film. For example, covers 53*b* and 54*b* may be polyethylene coating applied to the flat faces 53*a*1 and 54*a*1 of the bodies 53*a* and 54*a*.

Further, although the toner amount detector 50 is used to detect the amount of toner (I.e., developer) inside the development housing 40 of the developing device 4 in the description above, the above-described aspects of the toner amount detector 50 can adapt to other configurations. For example, the aspects of this specification can adapt to detection of the amount of waste toner collected in the toner collecting chamber 9.

Additionally, although the monochrome image forming apparatus is described above, various aspects of this specification can adapt to multicolor image forming apparatuses. Yet additionally, various aspects of this specification are applicable to printers, copiers, facsimile machines, and multifunction machines or multifunction peripherals (MFPs) having these capabilities.

Figure 13:
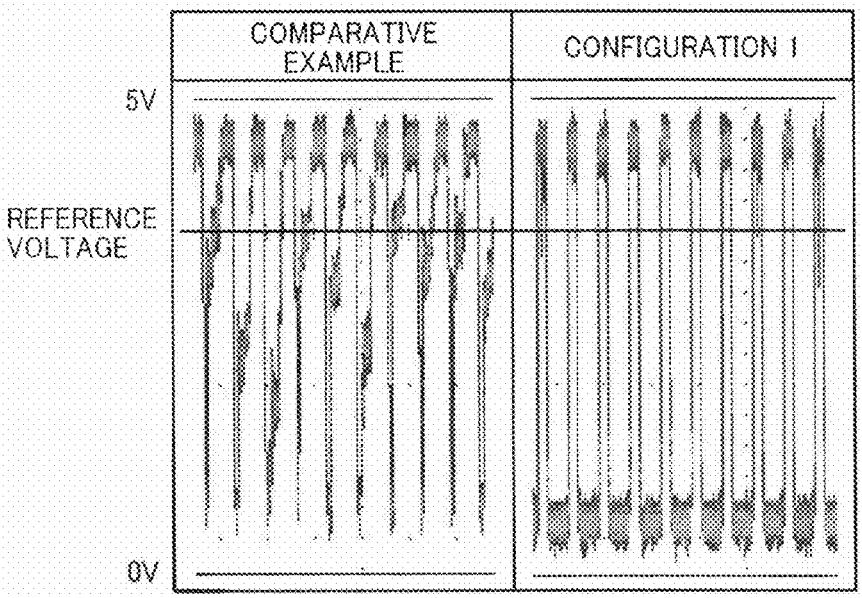
FIG. 13 illustrates results (a waveform) of a test executed to ascertain effects of the embodiment shown in FIGS. 3 through 10.

FIG. 13 shows results of a test executed to ascertain effects of the toner amount detector 50.

The test was conducted using the developing device 4 shown in FIGS. 3 through 10, the cleaner 60 constructed of a PET sheet, and one-component toner including a polyester toner base. In the test, a configuration 1 according to the above-described embodiment was compared with a comparative example. In the configuration 1, the covers 53*b* and 54*b* are pieces of polyethylene tape having a thickness of 100 μm and provided to the flat faces 53*a*1 and 54*a*1 of the first and second light guides 53 and 54. By contrast, in the comparative example, the flat faces 53*a*1 and 54*a*1 of the bodies 53*a* and 54*a* are not covered, and the flat faces 53*a*1 and 54*a*1 serve as the light-emitting face P1 and the light-receiving face P2, respectively.

In the test, voltage was input to the light-emitting element 51, an oscilloscope was connected to the light-receiving element 52, and the first and second developer conveyance members 44 and 45 were driven while the light-emitting element 51 emitted light. In each of the configuration 1 and the comparative example, light received by the light-receiving element 52 was detected using the oscilloscope.

FIG. 13 shows the results thereof.

A detection circuit used is configured as follows. When the light-receiving element 52 receives light (the light transmission path L is not blocked), voltage decreases, and "0 V" is detected. When the light-receiving element 52 does not receive light (the light transmission path L is blocked), a voltage of 5 V is detected. Accordingly, when the time period during which the voltage detected is at or greater than a reference voltage (a portion above the reference voltage in the waveform shown in FIG. 13, also referred to as "light blocking time") is longer than a predetermined period, it is judged that the amount of toner in the development housing 40 serving as the toner container is sufficient. When the light blocking time is shorter than the predetermined period, it is judged that the amount of toner therein is insufficient.

In the comparative example in which the flat faces 53*a*1 and 54*a*1 are not covered, the waveform is unstable. A conceivable cause thereof is that toner adheres to the light-emitting face P1 and the light-receiving face P2. If the waveform is unstable, the light blocking time is not detected accurately, thus degrading the accuracy in detecting the amount of toner. By contrast, in the configuration 1 in which the flat faces 53*a*1 and 54*a*1 are covered with polyethylene tape, the waveform is stable. Thus, it is confirmed that, according to the embodiments described above, the light blocking time can be detected accurately, and the detection accuracy in detecting the amount of toner in the toner container can be enhanced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developer amount detector to detect an amount of developer inside a developer container, the developer amount detector comprising:

a light-emitting element;

a light-receiving element;

a first light guide including a first end disposed to face the light-emitting element, a second end disposed inside the developer container, and a translucent cover to cover the second end of the first light guide, the cover including a light-emitting face;

a second light guide including a first end disposed to face the light-receiving element, a second end disposed inside the developer container, and a translucent cover to cover the second end of the second light guide, the cover including a light-receiving face to face the light-emitting face across a gap; and a cleaner including a sliding portion to slidingly contact the light-emitting face and the light-receiving face to remove developer adhering to the light-emitting face and the light-receiving face.

2. The developer amount detector according to claim 1, wherein the sliding portion comprises polyethylene terephthalate, and the cover of each of the first light guide and the second light guide comprises polyethylene.

3. The developer amount detector according to claim 2, wherein the developer amount detector is to detect an amount of developer including a polyester developer base.

4. The developer amount detector according to claim 1, wherein the cover of each of the first light guide and the second light guide comprises translucent film.

5. The developer amount detector according to claim 4, wherein the cover of each of the first light guide and the second light guide further comprises an adhesive layer on a back side of the translucent film.

6. The developer amount detector according to claim 4, wherein a thickness of the translucent film is not smaller than 10 μm and not greater than 200 μm.

7. The developer amount detector according to claim 1, wherein the body of each of the first light guide and the second light guide comprises one of polycarbonate resin and acrylic resin.

8. A developing device comprising:

a developer container to contain developer;

a developer conveying member disposed inside the developer container, the developer conveying member to transport developer by rotation; and the developer amount detector according to claim 1, wherein the cleaner is attached to the developer conveying member, and the sliding portion is to clean the light-emitting face and the light-receiving face as the clearer rotates together with the developer conveying member.

9. A process unit comprising the developing device according to claim 8.

10. An image forming apparatus comprising the process unit according to claim 9.

11. The developer amount detector according to claim 1, wherein the cover of each of the first light guide and the second light guide includes a material lower in chargeability with the sliding portion than a material of a body of each of the first light guide and the second light guide.

12. A developer amount detector to detect an amount of developer inside a developer container, the developer amount detector comprising:

a light-emitting element;

a light-receiving element;

a first light guide including a first end disposed to face the light-emitting element, a second end disposed inside the developer container, and a translucent cover to cover the second end of the first light guide, the cover including a light-emitting face;

a second light guide including a first end disposed to face the light-receiving element, a second end disposed inside the developer container, and a translucent cover to cover the second end of the second light guide, the cover including a light-receiving face to face the light-emitting face across a gap; and a cleaner including a sliding portion to slidingly contact the light-emitting face and the light-receiving face to remove developer adhering to the light-emitting face and the light-receiving face.

13. The developer amount detector according to claim 12, wherein the sliding portion comprises polyethylene terephthalate, and the cover of each of the first light guide and the second light guide comprises polyethylene.

14. The developer amount detector according to claim 13, wherein the developer amount detector is to detect an amount of developer including a polyester developer base.

15. The developer amount detector according to claim 12, wherein the cover of each of the first light guide and the second light guide comprises translucent film.

16. The developer amount detector according to claim 15, wherein the cover of each of the first light guide and the second light guide further comprises an adhesive layer on a back side of the translucent film.

17. The developer amount detector according to claim 15, wherein a thickness of the translucent film is not smaller than 10 μm and not greater than 200 μm.

18. The developer amount detector according to claim 12, wherein the body of each of the first light guide and the second light guide comprises one of polycarbonate resin and acrylic resin.

19. A developing device comprising:

a developer container to contain developer;

a developer conveying member disposed inside the developer container, the developer conveying member to transport developer by rotation; and the developer amount detector according to claim 13, wherein the cleaner is attached to the developer conveying member, and the sliding portion is to clean the light-emitting face and the light-receiving face as the clearer rotates together with the developer conveying member.

20. The developer amount detector according to claim 13, wherein the cover of each of the first light guide and the second light guide is lower in chargeability with the sliding portion than a body of each of the first light guide and the second light guide.

* * * * *